US012221860B2

(12) United States Patent
Lu et al.

(10) Patent No.: US 12,221,860 B2
(45) Date of Patent: Feb. 11, 2025

(54) WELLHEAD BRACING SYSTEM

(71) Applicant: Chevron U.S.A. Inc., San Ramon, CA (US)

(72) Inventors: Wangming Lu, Katy, TX (US); Khiem Nguyen, Fulshear, TX (US); Jay Patrick Painter, League City, TX (US); Caleb Kimbrell Carroll, Houston, TX (US); William Stephen Averill, Cypress, TX (US); Deryck Edward Matthew Williams, Houston, TX (US); David Crenshaw Barrow, Katy, TX (US); Michael Ryan Fitzsimmons, Katy, TX (US)

(73) Assignee: CHEVRON U.S.A. INC., San Ramon, CA (US)

( * ) Notice: Subject to any disclaimer, the term of this patent is extended or adjusted under 35 U.S.C. 154(b) by 0 days.

(21) Appl. No.: 18/473,235

(22) Filed: Sep. 23, 2023

(65) Prior Publication Data

US 2024/0110463 A1 Apr. 4, 2024

Related U.S. Application Data

(60) Provisional application No. 63/376,953, filed on Sep. 23, 2022.

(51) Int. Cl.
*E21B 41/00* (2006.01)
*E21B 33/035* (2006.01)

(52) U.S. Cl.
CPC ..... *E21B 41/0007* (2013.01); *E21B 33/035* (2013.01)

(58) Field of Classification Search
CPC ... E21B 41/0007; E21B 33/035; E21B 33/037
(Continued)

(56) References Cited

U.S. PATENT DOCUMENTS 2,532,341 A * 12/1950 Shannon ..... E21B 33/037 166/96.1
4,036,295 A * 7/1977 Kirkland ..... E21B 43/013 166/344

(Continued)

OTHER PUBLICATIONS

Almeida Da Silva, Magno, et al.; Changing the Game: Dp Rig in Shallow Waters Using Bop Tethering System and Real Time Riser Analysis; OTC-31980-MS; Apr. 25, 2022.

(Continued)

*Primary Examiner* — Tara Schimpf
*Assistant Examiner* — Patrick F Lambe
(74) *Attorney, Agent, or Firm* — King & Spalding LLP

(57) ABSTRACT

A wellhead bracing system for a subsea well includes a base plate assembly and a wellhead brace assembly. The base plate assembly comprises a top surface, a bottom surface, a base plate aperture, and a plurality of anchor holes. The wellhead brace assembly comprises a vertical plate assembly having a cylindrical shape, a horizontal plate assembly to which the vertical plate assembly is attached, and a vertical support assembly attached to an outer surface of the vertical plate assembly and attached to the top surface of the horizontal plate assembly. Horizontal plate holes of the horizontal plate assembly are configured to attach to studs on the top surface of the base plate to secure the wellhead brace assembly to the base plate assembly. The wellhead bracing system slides onto a wellhead of the subsea well and braces an exterior of the wellhead.

20 Claims, 8 Drawing Sheets

(58) Field of Classification Search
USPC ..... 166/368
See application file for complete search history.

(56) References Cited

U.S. PATENT DOCUMENTS

| | | | | |
|---|---|---|---|---|
| 4,220,421 | A * | 9/1980 | Thorne | E21B 33/037 166/368 |
| 2014/0374113 | A1* | 12/2014 | Kebadze | E21B 33/035 166/338 |
| 2014/0374115 | A1 | 12/2014 | Kebadze et al. | |
| 2019/0178046 | A1* | 6/2019 | Wang | E21B 47/07 |
| 2021/0054723 | A1* | 2/2021 | Jacobsen | E21B 7/12 |

OTHER PUBLICATIONS

Cardoso, Cristiano Bernabe, et al.; Challenges and Lessons Learned on the First Use of Tethered Bop in a Major Operator in Brazil; OTC-31859-MS; Apr. 25, 2022.

* cited by examiner

WELLHEAD BRACING SYSTEM

RELATED APPLICATIONS

The present application claims the benefit of U.S. Provisional Patent Application No. 63/376,953 filed Sep. 23, 2022, the entire content of which is incorporated herein by reference.

TECHNICAL FIELD

Embodiments of the technology relate generally to a bracing system for a subsea wellhead.

BACKGROUND

Offshore production of hydrocarbons typically involves drilling of a well, completing the well, and performing other workover operations. A wellhead is placed over the well opening at the seafloor. The subsea wellhead provides pressure containment for the well and can include the wellhead housings, the conductor casing and connectors, the surface casing and connectors, and, for some wells, additional casings and connectors between the conductor casing and the surface casing. The wellhead also provides a profile to latch the subsea blowout preventer stack, tree, tubing head spool, and riser equipment up to a floating rig at the water's surface. The riser equipment that extends upward from the wellhead is used in connection with performing the drilling, completion, and workover operations on the well. The riser equipment extending upward from the wellhead may be subjected to forces from ocean currents, waves, and movements from surface vessels. The movements on the riser equipment may cause stress on the wellhead. Other sources of stress on the wellhead may include vibrations in the seafloor as well as pressure and temperature cycles to which the wellhead is subjected. These sources of stress on the wellhead may cause fatigue damage to the wellhead over time. Wellhead fatigue damage can accumulate and negatively impact the useful life of the well.

Existing approaches to making a wellhead more resistant to fatigue are either overly complex and/or expensive to implement. Accordingly, improved techniques for addressing the stresses to which a wellhead is subjected would be beneficial.

SUMMARY

The present disclosure is generally directed to a system and method for bracing a subsea wellhead to protect against fatigue damage. In one example embodiment, a wellhead bracing system for a subsea well can include a base plate assembly and a wellhead brace assembly. The base plate assembly can comprise a top surface, a bottom surface, a base plate aperture, and a plurality of anchor holes. The wellhead brace assembly can comprise a vertical plate assembly, or vertical plate housing, having a cylindrical shape, a horizontal plate assembly to which the vertical plate assembly is attached, and a vertical support assembly attached to an outer surface of the vertical plate assembly and attached to the top surface of the horizontal plate assembly. Horizontal plate holes of the horizontal plate assembly are configured to attach to studs on the top surface of the base plate to secure the wellhead brace assembly to the base plate assembly. The wellhead bracing system can slide onto a wellhead of the subsea well and brace an exterior of the wellhead.

Another example embodiment is directed to a method for installing a wellhead bracing system on a subsea well. The method can comprise sliding the wellhead bracing system onto a wellhead of the subsea well, wherein the wellhead extends through a vertical plate assembly of the wellhead bracing system. The method can further comprise anchoring the wellhead bracing system around the wellhead by driving a plurality of anchor poles through anchor holes in a base plate assembly of the wellhead bracing system and into a seafloor in which the subsea well is located. Lastly, the method can further comprise pumping cement down through a drill string positioned in the wellhead and into an annulus between an inner surface of the vertical plate assembly and an exterior of the wellhead after anchoring the wellhead bracing system around the wellhead.

The foregoing embodiments are non-limiting examples and other aspects and embodiments will be described herein. The foregoing summary is provided to introduce various concepts in a simplified form that are further described below in the detailed description. This summary is not intended to identify required or essential features of the claimed subject matter nor is the summary intended to limit the scope of the claimed subject matter.

BRIEF DESCRIPTION OF THE DRAWINGS

The accompanying drawings illustrate only example embodiments of a system and method for a wellhead bracing system for subsea wells. Therefore, the examples provided are not to be considered limiting of the scope of this disclosure. The principles illustrated in the example embodiments of the drawings can be applied to alternate methods and apparatus. Additionally, the elements and features shown in the drawings are not necessarily to scale, emphasis instead being placed upon clearly illustrating the principles of the example embodiments. Certain dimensions or positions may be exaggerated to help visually convey such principles. In the drawings, the same reference numerals used in different embodiments designate like or corresponding, but not necessarily identical, elements.

DETAILED DESCRIPTION OF EXAMPLE EMBODIMENTS

Figure 1:
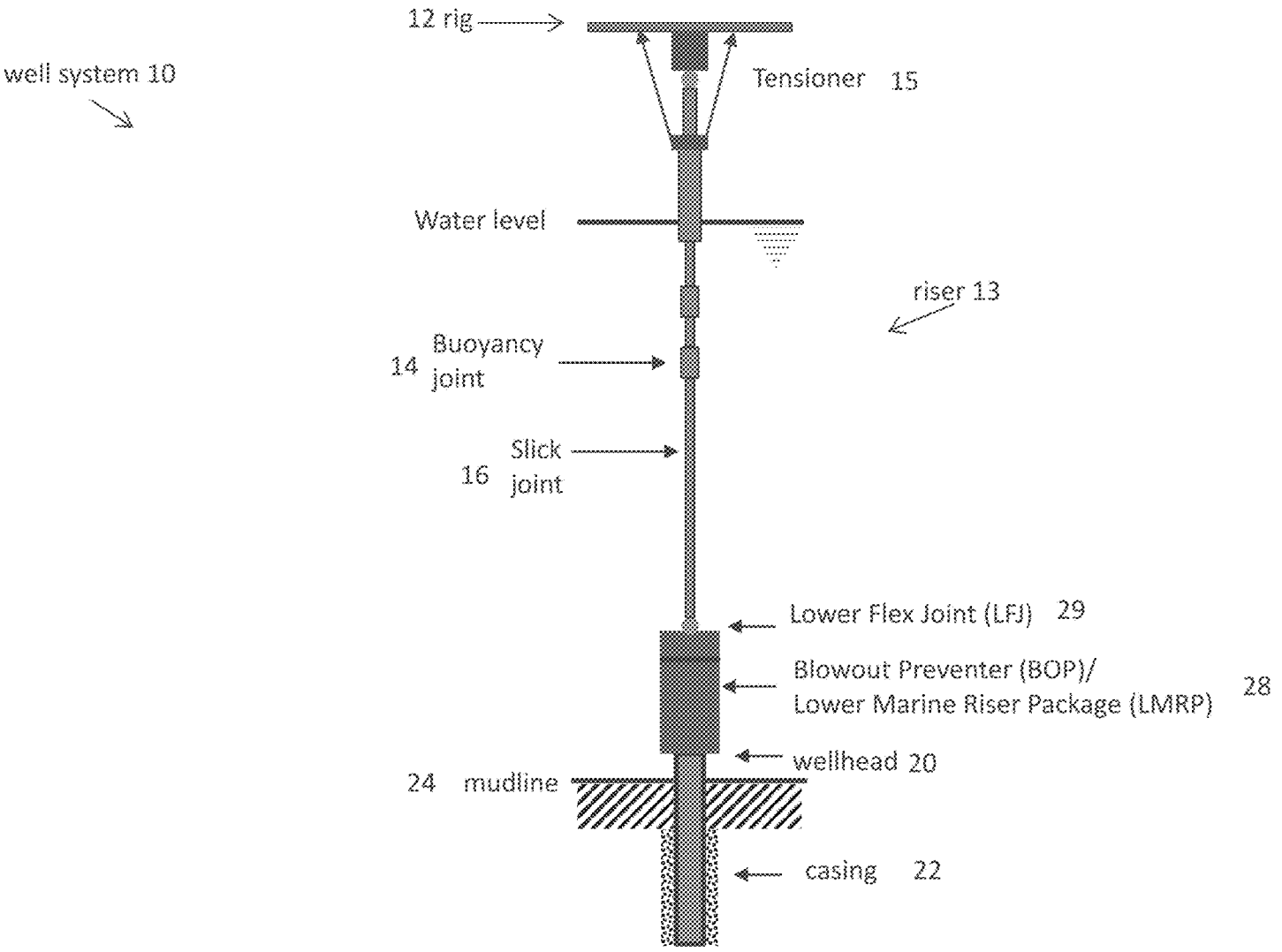
FIG. 1 illustrates an example subsea well system in accordance with an example embodiment of the disclosure.

The example embodiments discussed herein are directed to systems and methods for wellhead bracing systems for subsea wellheads. As explained above, subsea wellheads are subjected to stress from a variety of sources that cause fatigue damage to the wellhead over time. The amount of fatigue damage on a wellhead can affect planning for the rig at the surface, planning with respect to various operations performed on the well, and planning with respect to the operational life of the well. Given the complexity of drilling and operating a subsea well, it is desirable to improve fatigue damage resistance in the wellhead. One approach involves making the design and the materials of the wellhead more fatigue resistant. However, this approach can involve substantial increases in the costs associated with materials, fabrication, and installation of the well. Another approach involves isolating the source of loads on the wellhead, such as, for example, isolating the blow out preventer with a tethering system. However, such isolation approaches involve added equipment, complexity, and expense, and are not always reliable. Yet another approach involves external bracing systems attached to the wellhead. However, existing external bracing systems typically require design changes in the manufacture of the wellhead in order to be able to attach the external bracing system to the wellhead. However, design changes in the manufacture of the wellhead are difficult to implement and add complexity and cost.

The example embodiments described herein provide an improved approach to an external bracing system for a subsea wellhead with several advantages. First, the example embodiments of this disclosure provide a more flexible wellhead bracing system in that the bracing system does not require a custom interface between the specific wellhead and the wellhead bracing system. This flexibility allows the disclosed wellhead bracing system to be used with both new wellheads and to retrofit wellheads by placing the bracing system on existing wells. Applicability to existing wells is particularly useful as older wells can have less robust wellheads. Accordingly, the wellhead bracing system allows the well operator to continue operating an older well.

A second advantage with the disclosed embodiments is that the wellhead bracing system is bonded directly to the wellhead with cement. This approach with the disclosed wellhead bracing system simplifies the installation of the wellhead bracing system onto any wellhead without the need for modification of the wellhead.

A third advantage of the disclosed embodiments is the ability to more effectively damp vibrations impacting the wellhead and the wellhead bracing system. As described previously, the wellhead is subjected to vibrations from various sources including movement of the equipment attached to the wellhead seafloor and cyclical forces from waves and currents. The disclosed embodiments allow for the incorporation of a damping material as a component of the wellhead bracing system and the damping material can reduce the amplitude of vibrations, thereby mitigating fatigue damage to the wellhead.

While example embodiments of a wellhead bracing system are provided in the descriptions that follow, it should be understood that modifications to the embodiments described herein are within the scope of this disclosure. In the following paragraphs, particular embodiments will be described in further detail by way of example with reference to the drawings. In the description, well-known components, methods, and/or processing techniques are omitted or briefly described. Furthermore, reference to various feature(s) of the embodiments is not to suggest that all embodiments must include the referenced feature(s).

Referring now to FIG. 1, an example subsea well system 10 is illustrated. As will be described further, "well system" is used herein broadly to include the wellhead housings, casings, the blowout preventer with lower marine riser package, the riser system, and other equipment typically used in connection with a subsea well. The wellhead bracing systems described herein can be applied to support new subsea wells and can be applied to support existing subsea wells. The subsea well system 10 is simply provided as an example of the type of well system at which the example wellhead bracing systems describes herein can be applied, but it should be understood that the wellhead bracing systems can be used with other types of well systems. Furthermore, the components of the well system 10 illustrated in FIG. 1 are examples for illustration and it should be understood that the wellhead bracing systems described herein can be used with other well systems that can have an arrangement of components different from example well system 10.

As illustrated in FIG. 1, a rig 12 is positioned at or above the surface of the sea, which is indicated by the water level. A well in the subsea formation is lined with a casing 22 and covered with a wellhead 20. The wellhead 20 can comprise a system of housings, hangers, seals, adapters, and/or other equipment that provides pressure control and access to the well. The wellhead 20 is positioned over the well at the seafloor or mudline 24. FIG. 1 illustrates several components of the well system that are located between the rig 12 and the wellhead 20. A tensioner couples the rig 12 to the riser 13 and provides compensation for relative motion between the rig 12 and the riser 13. A buoyancy joint 14 located near the top of the well system 10 can assist in maintaining the stability of the well system 10. The buoyancy joint 14 is attached to slick joint 16, which extends downward toward the wellhead 20. A lower flexible joint 29 can couple the riser 13 to the wellhead 20 via a blowout preventer/lower marine riser package 28. The blowout preventer/lower marine riser package 28 can be a large valve or valves in series, or similar device that is used to seal off, control, and monitor the well to prevent uncontrolled release of fluids from the well.

Figure 14:
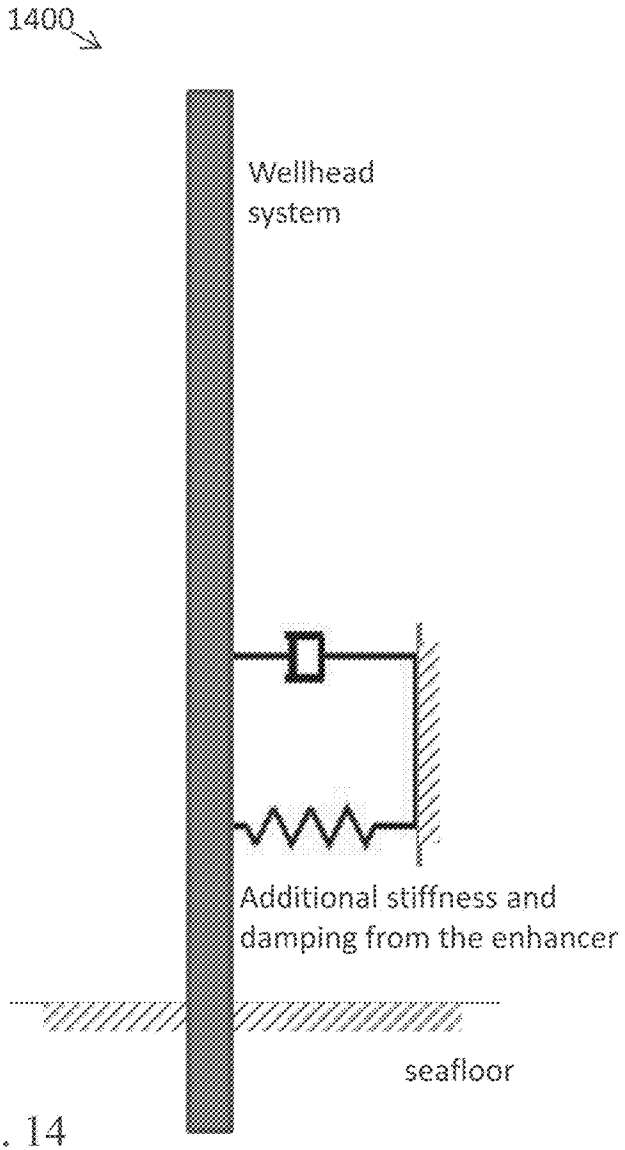
FIG. 14 illustrates a model of a braced well system in accordance with an example embodiment of the disclosure.
Figure 15:
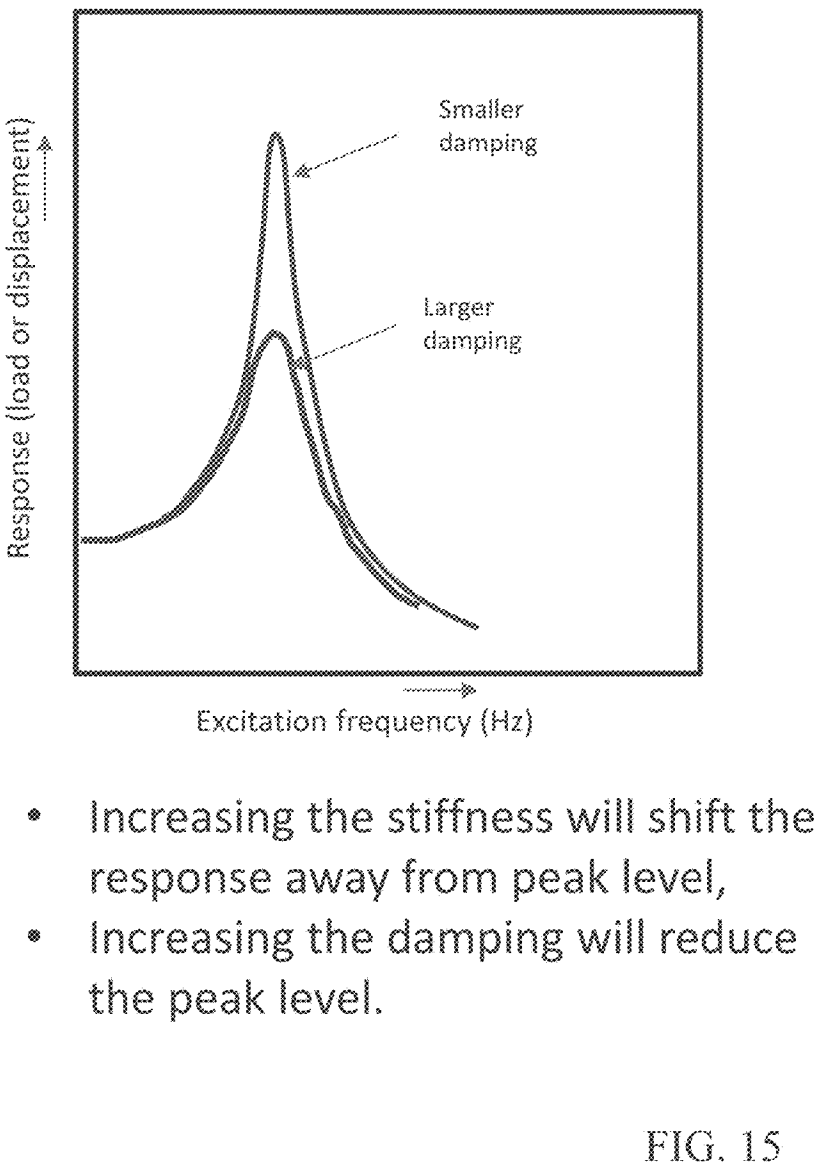
FIG. 15 illustrates the effect of bracing on a well system in accordance with an example embodiment of the disclosure.

Referring now to the remaining drawings, FIGS. 2-5 illustrate components of a wellhead bracing system to address stresses on the wellhead in accordance with an example embodiment of the disclosure. FIGS. 6-13 illustrate a method of installing a wellhead bracing system on an subsea wellhead in accordance with an example embodiment of the disclosure. Lastly, FIGS. 14 and 15 illustrate a model of a wellhead system and the effect of damping on a well system, respectively, in accordance with an example embodiment of the disclosure.

Figures 2, 3:
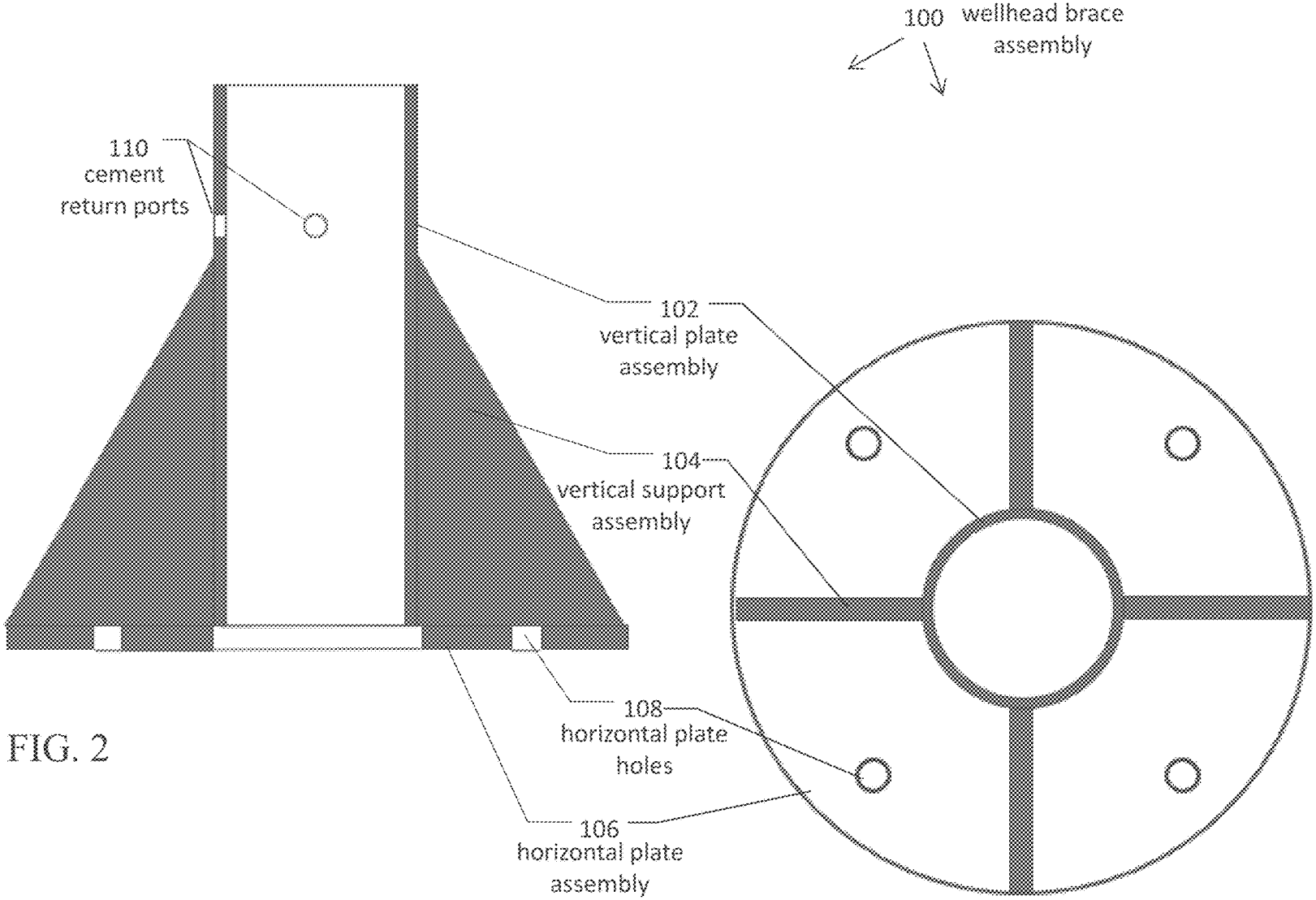
FIGS. 2 and 3 illustrate side and top views of an example wellhead brace in accordance with an example embodiment of the disclosure.

Referring now to FIGS. 2-5, the components of an example wellhead bracing system will be described in further detail. FIGS. 2 and 3 illustrate a wellhead brace assembly 100 that will be joined to a base plate assembly 120. The wellhead brace assembly 100 comprises a vertical plate assembly 102. The vertical plate assembly 102 is preferably in the shape of a cylinder so that it can slide onto and fit snugly around a wellhead in order to support the wellhead. Additionally, the vertical plate is preferably a single cylindrical plate to simplify the handling and installation of the wellhead bracing system onto a wellhead. However, it should be understood that in alternate embodiments the vertical plate assembly 102 can comprise multiple components that are joined to form a cylindrical shape or other desired shape for installation onto a wellhead.

As illustrated in FIGS. 2 and 3, the vertical plate assembly 102 is joined to a horizontal plate assembly 106. The horizontal plate assembly 106 is shown as a single plate having a generally disk-like shape with a top surface and a bottom surface, but it should be understood that in other embodiments the horizontal plate assembly 106 can comprise multiple components and can have shapes other than a disk. The horizontal plate assembly 106 includes a central aperture that aligns with the cylindrical opening of the vertical plate assembly 102. The horizontal plate assembly 106 also includes a plurality of horizontal plate holes 108 for securing the wellhead brace assembly 100 to the base plate assembly 120 of FIGS. 4 and 5.

Lastly, the wellhead brace assembly 100 includes a vertical support assembly 104. The vertical support assembly can comprise one or more support members that are attached to both the vertical plate assembly 102 and the horizontal plate assembly 106. The one or more support members of the vertical support assembly 104 are oriented vertically to support the vertical plate assembly 102. In the example of FIGS. 2 and 3, the vertical support assembly 104 comprises four triangular shaped support members spaced equally about the circumference of the vertical plate assembly 102. The members of the vertical support assembly 104 are joined at their bottoms to the top surface of the horizontal plate assembly 106 and are joined along one side to the vertical plate assembly 102. The members of the vertical support assembly 104 counteract forces from the wellhead against the vertical plate assembly 102 when the wellhead bracing system is installed on a wellhead. Additionally, the vertical support assembly reinforces the joint between the vertical plate assembly 102 and the horizontal plate assembly 106. It should be understood that in alternate embodiments the vertical support assembly can comprise fewer or greater members and the members can have different shapes or configurations.

Figure 5:
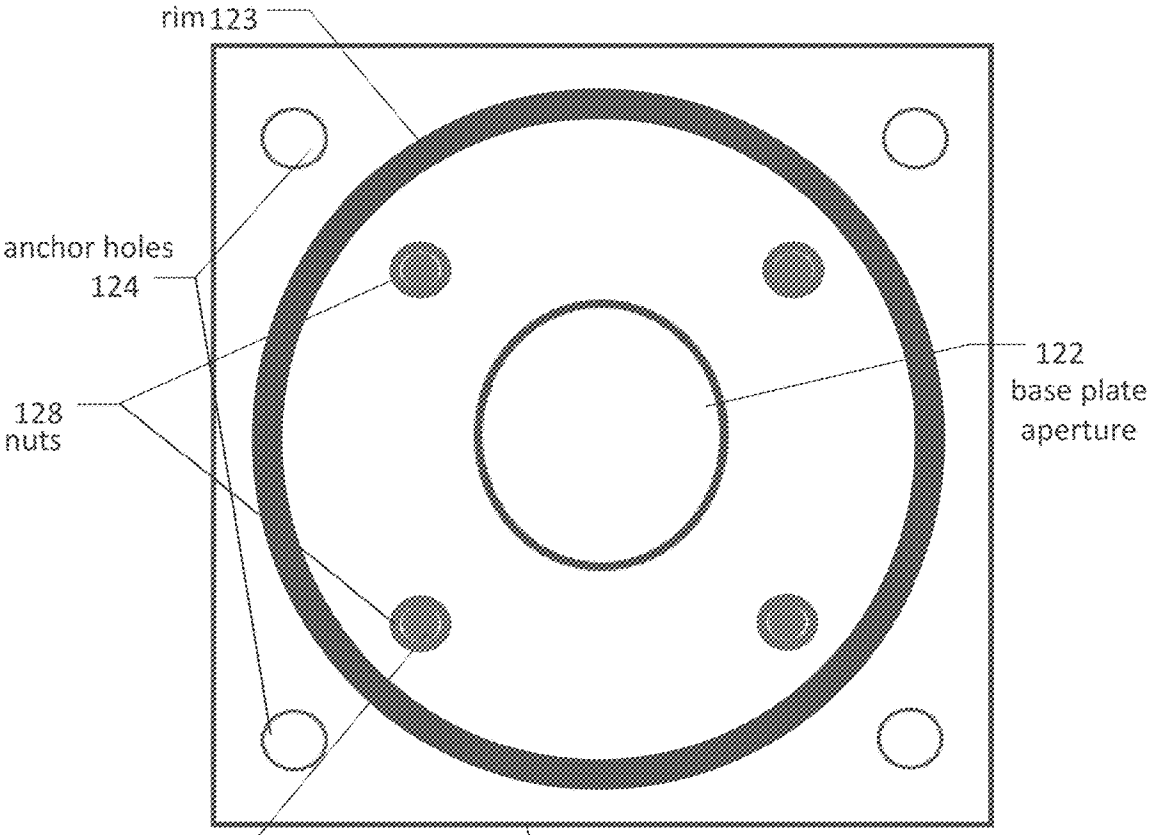
FIGS. 4 and 5 illustrate side and top views of an example base plate in accordance with an example embodiment of the disclosure.
Figure 4:
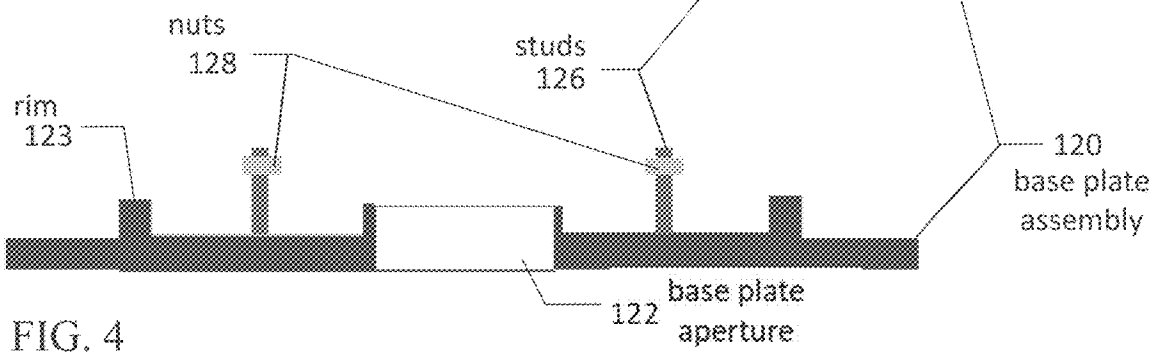

FIGS. 4 and 5 illustrate an example of the base plate assembly 120 of the wellhead bracing system. As will be described further below, the wellhead brace assembly 100 of FIGS. 2 and 3 is attached to the base plate assembly 120. The example base plate assembly 120 of FIGS. 4 and 5 has a square shape with a top surface and a bottom surface. A base plate aperture 122 passes through the thickness of the base plate assembly 120 and will be aligned with the cylindrical opening of the vertical plate assembly when joined to the wellhead brace assembly 100. The top surface of the base plate assembly 120 includes studs 126 that pass through the horizontal plate holes 108 when the wellhead brace assembly 100 is mounted onto the base plate assembly 120. Additionally, nuts 128 can be threaded onto the studs after the wellhead brace assembly 100 is mounted onto the base plate assembly 120. The example base plate assembly 120 of FIGS. 4 and 5 shows four studs 126 with nuts 128 spaced equidistantly about the base plate aperture 122. However, it should be understood that alternate embodiments may employ different numbers and different types of fastening mechanisms.

The example base plate assembly 120 includes an optional rim 123 that extends upward from the top surface of the base plate assembly 120. As will be described further below, the rim provides a border within which with the wellhead brace assembly 100 sits when it is mounted to the base plate assembly 120. The rim 123 also can serve to contain a damping material that can be placed between the base plate assembly 120 and the wellhead brace assembly 100.

Lastly, the base plate assembly 120 includes anchor holes 124. The anchor holes can receive an anchor pole that is driven through the base plate assembly 120 and into the seafloor as will be described further below. While the example of FIGS. 4 and 5 shows an anchor hole positioned at each corner of the base plate assembly 120, other embodiments of the base plate assembly can include a fewer or greater number of anchor holes at various positions on the base plate assembly.

While the wellhead bracing system illustrated in FIGS. 2-5 is shown as having two primary components—the wellhead brace assembly 100 and the base plate assembly 120—that are joined, it should be understood that other examples of the wellhead bracing system can be a single integrated component or can be more than two primary components. Additionally, it should be understood that the components the wellhead bracing system illustrated in FIGS. 2-5 are preferably made of steel or other durable materials that can withstand the stresses and extreme environmental conditions encountered around a wellhead on the seafloor.

Figures 6, 7:
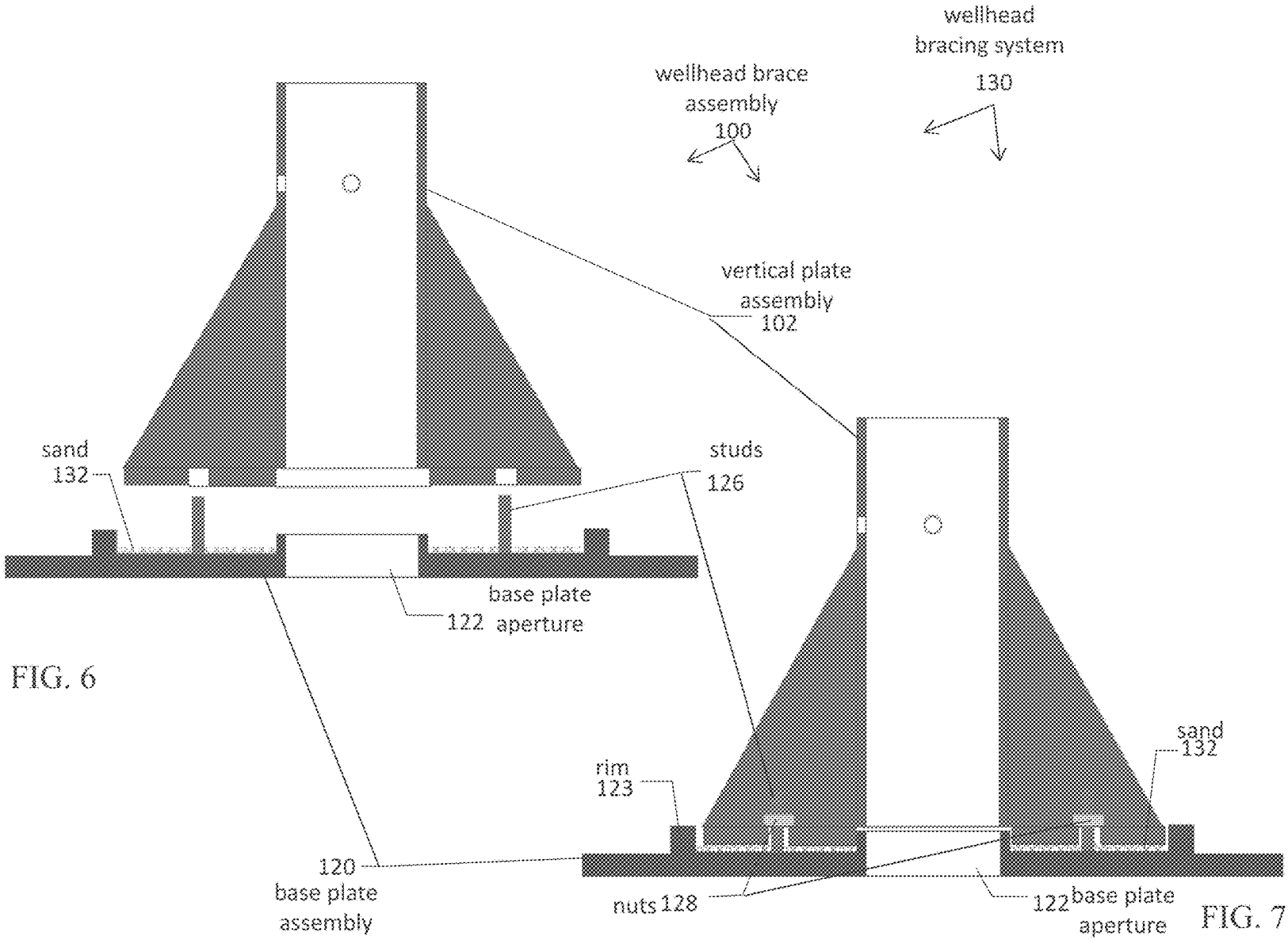
FIGS. 6 and 7 illustrate side views of a wellhead bracing system in accordance with an example embodiment of the disclosure.

Referring now to FIGS. 6-13, a method of installing a wellhead bracing system on an subsea wellhead will be described. FIGS. 6 and 7 illustrate the mounting of the wellhead brace assembly 100 onto the base plate assembly 120. FIGS. 6 and 7 show the cylindrical opening of the vertical plate assembly 102 aligned with the base plate aperture 122 as the two components are joined. The figures also show the studs 126 extending from the top surface of the base plate assembly 120 and passing through the horizontal plate holes 108 of the wellhead brace assembly 100. When the wellhead brace assembly 100 is mounted onto the base plate assembly 120, it fits within the rim 123.

FIGS. 6 and 7 also illustrate that damping material 132, in this example sand, can be placed on the top surface of the base plate assembly 120 within the rim 123 before the wellhead brace assembly 100 is mounted onto the base plate assembly 120. The rim 123 can contain the damping material in the area between the wellhead brace assembly 100 and the base plate assembly 120. The damping material can assist in mitigating vibrations that can cause stress on the wellhead and the wellhead bracing system. As explained previously, such vibrations can arise from seabed currents and the equipment attached to the wellhead. Aside from sand, examples of other damping materials that can be used include polymers, clays, and oils.

It should be understood that the wellhead bracing system illustrated in FIGS. 6 and 7 can be modified to suit various types of wells and environments. As one example, if the need for a damping material to address vibrations is less of a concern, the wellhead brace assembly 100 and the base plate assembly 120 can be integrated into a single component to simplify installation. With such an integrated component, the steps of joining the wellhead brace assembly 100 to the base plate assembly 120 could be eliminated and one could proceed directly to the method illustrated in FIGS. 8-13 for installing the wellhead bracing system on a wellhead. In another variation, where an integrated component is desired with some damping capability, the wellhead brace assembly 100 and the base plate assembly 120 could be a single integrated component, but with an interior cavity that provides damping. In such an embodiment, the interior cavity could contain a damping material. These and other variations of the wellhead bracing system can be used in conjunction with the methods described herein.

Figures 8, 9:
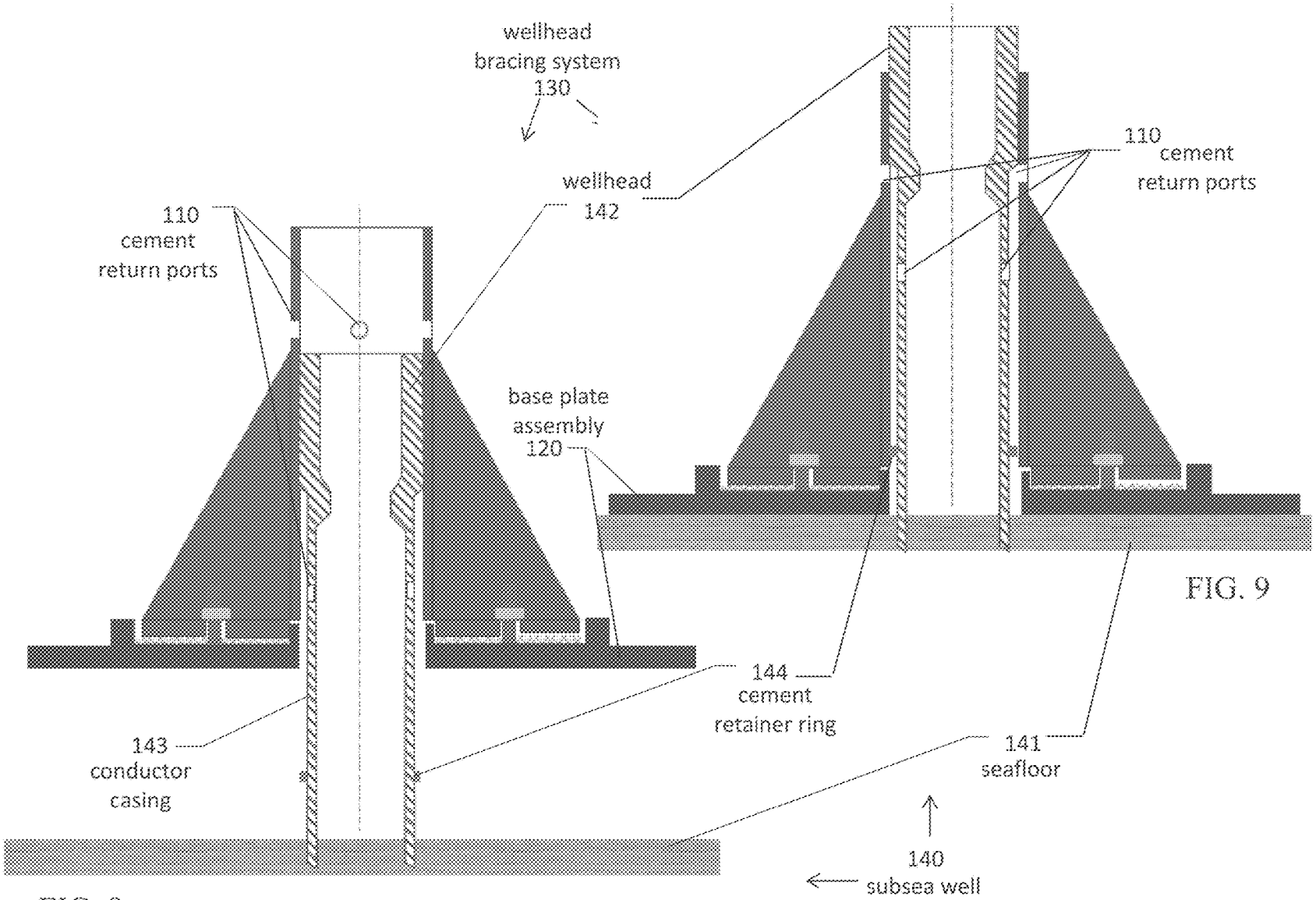
FIGS. 8, 9, and 10 illustrate a method of installing a wellhead bracing system in accordance with an example embodiment of the disclosure.

Turning to FIGS. 8-13, the remaining steps in the example method for installing the wellhead bracing system are illustrated. FIGS. 8 and 9 show the wellhead bracing system 130 being installed onto a wellhead 142 of a subsea well 140. The wellhead 142 can be a newly installed wellhead on a well that is being drilled. Alternatively, the wellhead 142 can be part of an existing well that is being retrofitted by reinforcing the wellhead with the wellhead bracing system 130. As illustrated in FIGS. 8 and 9, the wellhead bracing system 130 slides over the wellhead 142 and slides down the conductor casing 143 that extends downward from the wellhead 142. The wellhead bracing system 130 slides down the conductor casing 143 until it rests on the seafloor 141. As also shown in FIGS. 8 and 9, a cement retainer ring is attached to an exterior surface of the conductor casing 143 before the wellhead bracing system 130 slides down the conductor casing 143.

Figures 10, 11:
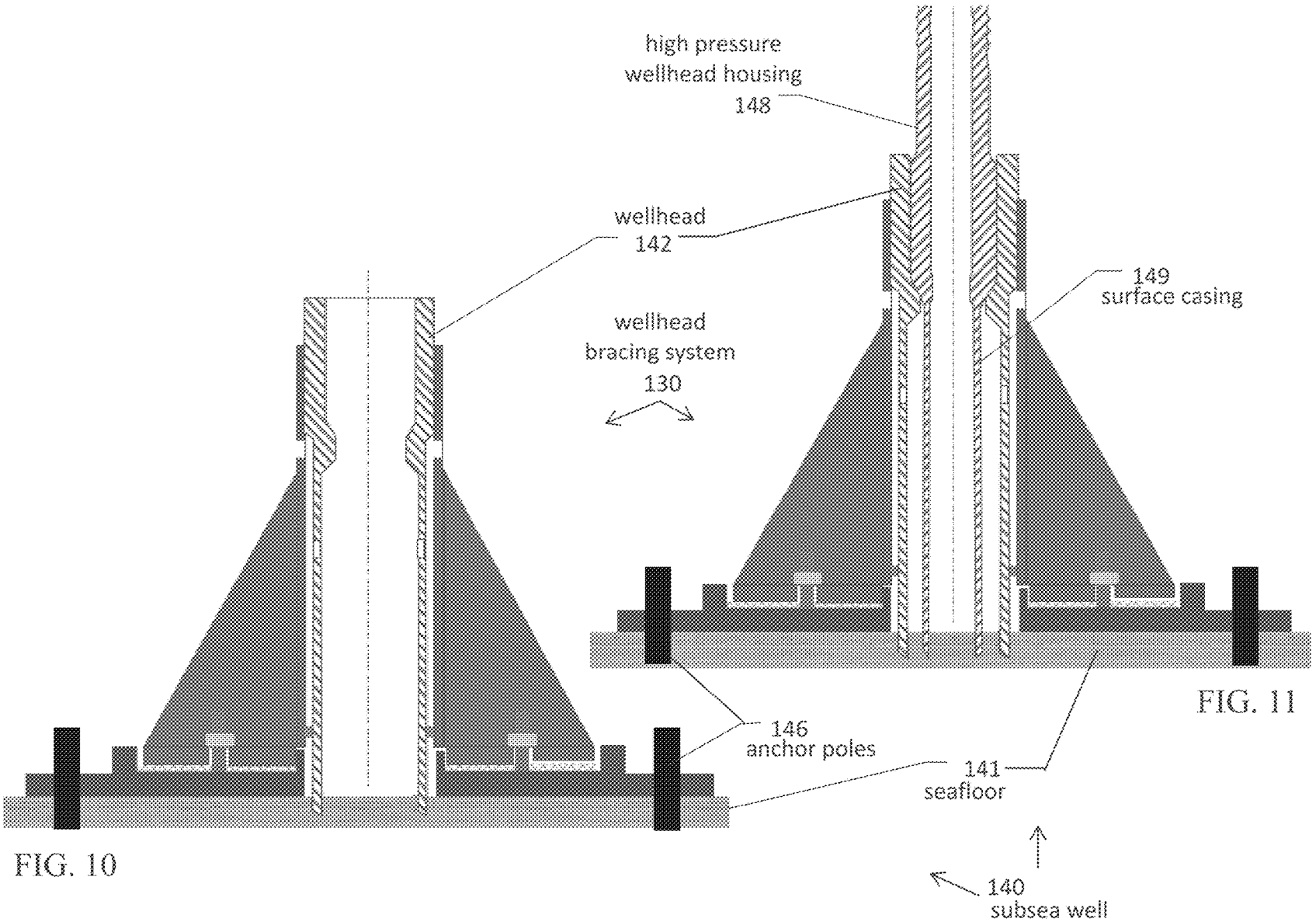
FIG. 11 illustrates a method of landing a high pressure wellhead housing and surface casing in a low pressure wellhead housing in accordance with an example embodiment of the disclosure.

Once the wellhead bracing system 130 is resting on the seafloor 141, anchor poles 146 are used to secure the wellhead bracing system 130 to the seafloor 141, as illustrated in FIG. 10. The anchor poles 146 are driven through the anchor holes 124 of the base plate assembly 120 and into the seafloor 141. In alternate embodiments, a fewer or greater number of anchor poles can be used.

The next step of the installation method is illustrated in FIG. 11 wherein a high pressure wellhead housing 148 and its associated surface casing 149 are installed within the wellhead 142. As can be seen in FIG. 11, the exterior of the high pressure wellhead housing 148 interfaces with a narrow section on the interior surface of the wellhead 142.

Figures 12, 13:
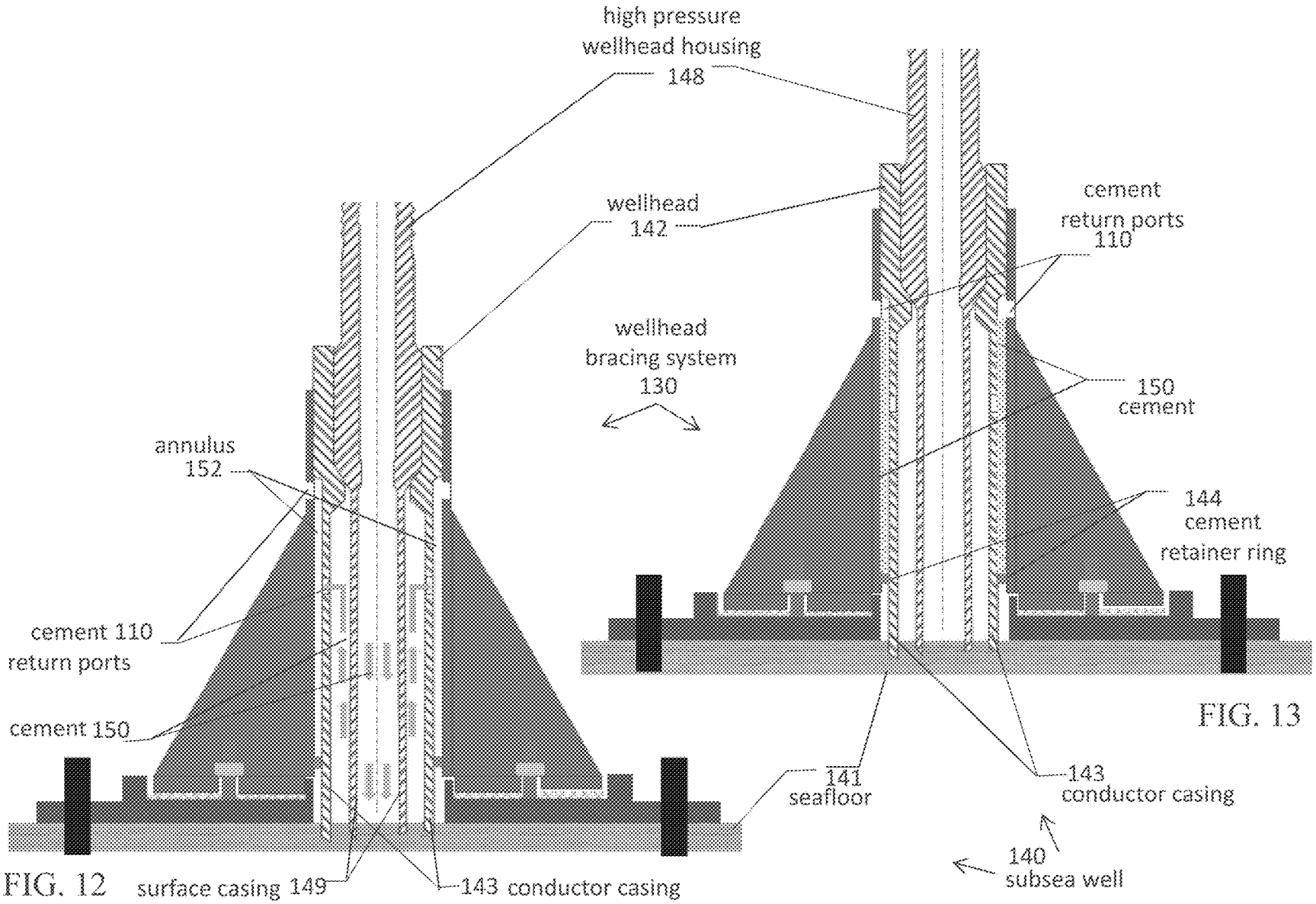
FIGS. 12 and 13 illustrate a method of cementing a wellhead bracing system in accordance with an example embodiment of the disclosure.

Referring to FIGS. 12 and 13, the next steps of the method involve cementing the wellhead bracing system 130 to the wellhead 142. As illustrated in FIG. 12, cement 150 is pumped from a floating platform at the water's surface down through the high pressure wellhead housing 148 and surface casing 149. Once reaching the end of the surface casing 149, the cement 150 is directed upward through the annulus between the surface casing 149 and the conductor casing 143. As one example, a packer (not shown) can seal an inner diameter of the conductor casing 143 below the surface casing 149, thereby causing the cement 150 to be redirected upward into the annulus between the surface casing 149 and the conductor casing 143. As illustrated in FIG. 12, the cement 150 proceeds upward through the annulus and then passes through cement return ports 110 in the conductor casing 143. After passing through the cement return ports 110 in the conductor casing 143, the cement 150 fills the outer annulus between the wellhead bracing system 130 and the outer surface of the conductor casing 143. In the outer annulus, the cement 150 fills the outer annulus in a space with a lower boundary set by the cement retainer ring 144. The cement 150 can fill the outer annulus upward toward the cement return ports 110 in the wellhead bracing system 130. The cement return ports 110 in the wellhead bracing system 130 allow air to escape as the cement 150 fills the outer annulus. Once the cement 150 sets, it bonds the wellhead bracing system 130 directly to the outer surface of the wellhead 142. As such, the wellhead bracing system 130 can be used on a variety of wellheads and does not require additional interface components or other customized equipment. Once bonded to the outer surface of the wellhead 142, the wellhead bracing system 130 reinforces the wellhead 142 against loads that stress the wellhead 142. Additionally, the damping material 132 in the wellhead bracing system 130 absorbs vibrations to assist in mitigating loads applied to the wellhead 142.

Referring now to FIG. 14, a model 1400 of a braced wellhead system is provided to illustrate the benefits of the wellhead bracing system on the wellhead system. In particular, the wellhead bracing system can add both stiffness, for reinforcing the wellhead system, and damping, for mitigating the effects of vibrations on the riser and subsea stack and the wellhead system. FIG. 15 is an example data plot illustrating the benefits of larger damping in mitigating the effects of vibrations on the riser and subsea stack and the wellhead system.

Assumptions and Definitions

For any figure shown and described herein, one or more of the components may be omitted, added, repeated, and/or substituted. Accordingly, embodiments shown in a particular figure should not be considered limited to the specific arrangements of components shown in such figure. Further, if a component of a figure is described but not expressly shown or labeled in that figure, the label used for a corresponding component in another figure can be inferred to that component. Conversely, if a component in a figure is labeled but not described, the description for such component can be substantially the same as the description for the corresponding component in another figure.

With respect to the example methods described herein, it should be understood that in alternate embodiments, certain steps of the methods may be performed in a different order, may be performed in parallel, or may be omitted. Moreover, in alternate embodiments additional steps may be added to the example methods described herein. Accordingly, the example methods provided herein should be viewed as illustrative and not limiting of the disclosure.

Terms such as "first" and "second" are used merely to distinguish one element (or state of an element) from another. Such terms are not meant to denote a preference and are not meant to limit the embodiments described herein. In the example embodiments described herein, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

The terms "a," "an," and "the" are intended to include plural alternatives, e.g., at least one. The terms "including", "with", and "having", as used herein, are defined as comprising (i.e., open language), unless specified otherwise.

Values, ranges, or features may be expressed herein as "about", from "about" one particular value, and/or to "about" another particular value. When such values, or ranges are expressed, other embodiments disclosed include the specific value recited, from the one particular value, and/or to the other particular value. Similarly, when values are expressed as approximations, by use of the antecedent "about," it will be understood that the particular value forms another embodiment. It will be further understood that there are a number of values disclosed therein, and that each value is also herein disclosed as "about" that particular value in addition to the value itself. In another aspect, use of the term "about" means±20% of the stated value, ±15% of the stated value, ±10% of the stated value, ±5% of the stated value, ±3% of the stated value, or ±1% of the stated value.

Although embodiments described herein are made with reference to example embodiments, it should be appreciated by those skilled in the art that various modifications are well within the scope of this disclosure. Those skilled in the art will appreciate that the example embodiments described herein are not limited to any specifically discussed application and that the embodiments described herein are illustrative and not restrictive. From the description of the example embodiments, equivalents of the elements shown therein will suggest themselves to those skilled in the art, and ways of constructing other embodiments using the present disclosure will suggest themselves to practitioners of the art. Therefore, the scope of the example embodiments is not limited herein.

What is claimed is:

1. A wellhead bracing system for a subsea well, the wellhead bracing system comprising:

a base plate assembly comprising a top surface, a bottom surface, a base plate aperture, and a plurality of anchor holes; and a wellhead brace assembly comprising:

a vertical assembly having a cylindrical shape formed by an outer cylindrical surface, an inner cylindrical surface, and opposing circular end surfaces, a horizontal plate assembly to which the vertical assembly is attached, and a vertical support assembly directly attached to the outer cylindrical surface of the vertical assembly and directly attached to a top surface of the horizontal plate assembly, wherein horizontal plate holes of the horizontal plate assembly directly attach to studs on the top surface of the base plate assembly to secure the wellhead brace assembly to the base plate assembly, and wherein the wellhead bracing system slides onto a wellhead of the subsea well and braces an exterior of the wellhead.

2. The wellhead bracing system of claim 1, further comprising cement that is injected into an annulus between the inner cylindrical surface of the vertical assembly and the exterior of the wellhead after the wellhead bracing system slides onto the wellhead.

3. The wellhead bracing system of claim 2, wherein the cement is injected downward through a drill string within the wellhead and into the annulus.

4. The wellhead bracing system of claim 3, further comprising:

a cement retainer ring positioned within the annulus; and at least one cement return port in the vertical assembly, wherein the cement is injected into the annulus between the cement retainer ring and the at least one cement return port, and wherein the cement retainer ring is located at a height within the annulus that is above the base plate assembly and below the at least one cement return port.

5. The wellhead bracing system of claim 4, further comprising a damping material located in a cavity between the top surface of the base plate assembly and a bottom surface of the horizontal plate assembly.

6. The wellhead bracing system of claim 5, wherein the cavity extends radially along the base plate assembly, wherein the base plate assembly comprises a rim that surrounds an outer perimeter of the cavity in which the damping material is located, and wherein the damping material is in direct contact with the top surface of the base plate assembly and the bottom surface of the horizontal plate assembly.

7. The wellhead bracing system of claim 1, further comprising:

a plurality of anchor poles, wherein one of the plurality of anchor poles passes through each of the plurality of anchor holes in the base plate assembly, and wherein the anchor poles anchor the wellhead bracing system to a seafloor in which the subsea well is located.

8. The wellhead bracing system of claim 7, wherein each of the plurality of anchor poles is adjustable for modifying a damping characteristic of the wellhead bracing system.

9. The wellhead bracing system of claim 1, wherein the horizontal plate assembly comprises a single disk-shaped plate.

10. The wellhead bracing system of claim 1, wherein the vertical support assembly comprises a plurality of vertical supports, wherein each of the plurality of vertical supports is directly attached to the outer cylindrical surface of the vertical assembly and directly attached to the top surface of the horizontal plate assembly.

11. The wellhead bracing system of claim 1, wherein the base plate assembly comprises a plurality of plates arranged in a spoke configuration about the vertical assembly.

12. The wellhead bracing system of claim 1, wherein the vertical assembly comprises a single cylindrical shape.

13. The wellhead bracing system of claim 1, wherein the vertical assembly comprises two semi-cylindrical shapes.

14. A method for installing a wellhead bracing system on a subsea well comprising:

sliding the wellhead bracing system onto a wellhead of the subsea well, wherein the wellhead extends through a vertical assembly of the wellhead bracing system, the vertical assembly having a cylindrical shape formed by an outer cylindrical surface, an inner cylindrical surface, and opposing circular end surfaces;

anchoring the wellhead bracing system around the wellhead by driving a plurality of anchor poles through anchor holes in a base plate assembly of the wellhead bracing system and into a seafloor in which the subsea well is located; and pumping cement down through a drill string positioned in the wellhead and into an annulus between the inner cylindrical surface of the vertical assembly and an exterior of the wellhead after anchoring the wellhead bracing system around the wellhead.

15. The method of claim 14, further comprising:

forming the wellhead bracing system by joining a wellhead brace assembly to the base plate assembly, wherein the wellhead brace assembly comprises the vertical plate assembly, a horizontal plate assembly to which the vertical plate assembly is attached, and a vertical support assembly directly attached to the outer cylindrical surface of the vertical plate assembly and directly attached to a top surface of the horizontal plate assembly.

16. The method of claim 15, further comprising:

placing a damping material in a cavity between a top surface of the base plate assembly and a bottom surface of the horizontal plate assembly.

17. The method of claim 16, wherein the cavity extends radially along the base plate assembly, wherein the base plate assembly comprises a rim that surrounds an outer perimeter of the cavity in which the damping material is located, and wherein the damping material is in direct contact with the top surface of the base plate assembly and the bottom surface of the horizontal plate assembly.

18. The method of claim 14, further comprising:

positioning a cement retainer ring within the annulus, wherein the cement is pumped into the annulus between the cement retainer ring and at least one cement return port, wherein the cement retainer ring is located at a height within the annulus that is above the base plate assembly and below the at least one cement return port.

19. The method of claim 14, wherein each of the plurality of anchor poles is adjustable for modifying a damping characteristic of the wellhead bracing system.

20. The method of claim 15, wherein the vertical support assembly comprises a plurality of vertical supports, wherein each of the plurality of vertical supports is attached to an outer surface of the vertical assembly and the top surface of the horizontal plate assembly.

* * * * *